US008579394B2

(12) United States Patent
Lee et al.

(10) Patent No.: US 8,579,394 B2
(45) Date of Patent: Nov. 12, 2013

(54) REFRIGERATOR

(75) Inventors: Moonseok Lee, Gyeongsangnam-do (KR); Jeongho Shin, Gyeongsangnam-do (KR); Raeyoung Park, Gyeongsangnam-do (KR); Hyunju Yi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 349 days.

(21) Appl. No.: 12/889,467

(22) Filed: Sep. 24, 2010

(65) Prior Publication Data

US 2011/0140585 A1 Jun. 16, 2011

(30) Foreign Application Priority Data

Dec. 16, 2009 (KR) ..... 10-2009-0125347

(51) Int. Cl.
*A47B 96/04* (2006.01)

(52) U.S. Cl.
USPC ..... 312/405; 16/244

(58) Field of Classification Search
USPC ..... 312/405, 401, 405.1, 319.2, 329, 326, 312/296; 16/240, 241, 244, 245; 49/388, 49/381, 385
See application file for complete search history.

(56) References Cited

U.S. PATENT DOCUMENTS

| | | | | | |
|---|---|---|---|---|---|
| 3,299,573 | A * | 1/1967 | Gustafson | 49/388 |
| 3,511,300 | A * | 5/1970 | Matyas | 160/206 |
| 3,683,453 | A * | 8/1972 | McLeland et al. | 16/248 |
| 3,866,658 | A * | 2/1975 | Smith | 160/206 |
| 4,109,346 | A * | 8/1978 | Strozier | 16/235 |
| 4,386,646 | A * | 6/1983 | Matyas | 160/206 |
| 4,977,642 | A * | 12/1990 | Marinoni | 16/257 |
| 5,054,163 | A * | 10/1991 | Sterling et al. | 16/244 |
| 5,228,240 | A * | 7/1993 | Barroero et al. | 49/386 |
| 5,548,869 | A * | 8/1996 | Ryczek | 16/93 R |
| 5,568,673 | A * | 10/1996 | Ryczek | 16/244 |
| 6,138,341 | A * | 10/2000 | Barroero et al. | 29/527.1 |
| 2005/0262663 | A1* | 12/2005 | Lee | 16/221 |
| 2006/0143860 | A1* | 7/2006 | Park et al. | 16/243 |
| 2006/0260097 | A1* | 11/2006 | Tate et al. | 16/309 |
| 2008/0276424 | A1* | 11/2008 | Gunderson | 16/286 |
| 2009/0038117 | A1* | 2/2009 | Moon | 16/240 |

* cited by examiner

*Primary Examiner* — Darnell Jayne
*Assistant Examiner* — Hiwot Tefera
(74) *Attorney, Agent, or Firm* — Fish & Richardson P.C.

(57) ABSTRACT

A refrigerator that includes a storage room and a door configured to provide or prevent access to the storage room is described. In the refrigerator, a hinge assembly connects the door to the storage room at a height relative that can be adjusted by operating the hinge assembly. To do so, the hinge assembly includes a hinge shaft having a screw thread and an adjustment member movable along the hinge shaft. Thus, the hinge assembly supports the door and allows adjustment to the height of the door relative to the storage room.

9 Claims, 7 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2009-0125347 filed on Dec. 16, 2009, which is hereby incorporated by reference in its entirety.

BACKGROUND

The present disclosure relates to a refrigerator.

Generally, a refrigerator is a home appliance, which stores foods in a storage space that is covered by a refrigerator door to keep foods at low temperatures, and enables foods to be stored in a fresh state by cooling the inside of the storage space using cold air generated through heat exchange with refrigerant that circulates through a cooling cycle.

Due to changes in dietary life and well-being trends, consumers prefer larger, multi-functional refrigerators, and various convenient refrigerators have been introduced in the market.

A refrigerator includes a main body defining a storage space and a door rotatably coupled to the main body. The door may be coupled to the main body by a hinge assembly.

SUMMARY

The specification describes a refrigerator including a hinge assembly, which can support a door and adjust a height of the door.

One innovative aspect of the subject matter described here can be implemented as a refrigerator including a storage room defining a storage space, a door configured to open and close to provide or prevent access to the storage room, and a hinge assembly configured to connect the door to the storage room at a height relative to the storage room. The hinge assembly is configured to enable adjustment to the height of the door. The hinge assembly includes a hinge bracket supporting a lower side of the door, a hinge shaft coupled to the hinge bracket to provide a rotation center about which the door rotates, the hinge shaft having a first screw thread, and a vertically movable adjustment member disposed on the lower side of the door, the adjustment member having a second screw thread coupled to the first screw thread.

This, and other aspects, can include one or more of the following features. The hinge assembly can be configured to enable adjustment to the height of the door from a first position that is at a first height relative to the storage room prior to the adjustment to the height of the door to a second position that is at a second height relative to the storage room after the adjustment to the height of the door. The second height can be different from the first height. The hinge shaft can include a fixing part coupled to the hinge bracket. A screw part can extend upwardly from the fixing part. The screw part can have the first screw thread on an outer surface thereof. An insertion part can be inserted into the door. The first screw thread can be disposed on an inner surface of the adjustment member. The adjustment member can be configured to be rotatably coupled to the outside of the screw part. The hinge assembly can further include a damping member coupled to the inside of the door and can be configured to reduce a speed of the door when the door is closed. A damping member shaft can extend to the lower side of the door and be coupled to the hinge shaft. The damping member shaft can be configured to rotate relative to the damping member. A door shaft providing the rotation center of the door can be included. The door shaft can be configured for insertion into the hinge shaft. The hinge shaft can include an insertion part configured to be movably inserted into the door. The door can include a hinge receiving part configured to receive the insertion part and having a length greater than that of the insertion part.

Another innovative aspect of the subject matter described here can be implemented as a refrigerator including a cabinet defining a storage room; a door rotatably disposed at a side of the cabinet, the door configured to open and close to provide or prevent access to the storage room, wherein the door is disposed at a height relative to the cabinet; a hinge bracket disposed on the door, the hinge bracket supporting a load of the door; a hinge shaft extending upwardly from the hinge bracket, the hinge shaft having a first screw thread; and an adjustment member screw-coupled to the hinge shaft, the adjustment member supporting a lower side of the door. The adjustment member is rotatably coupled to the outside of the hinge shaft. The adjustment member is configured such that the door is vertically moved when the adjustment member is rotated to adjust the height.

This, and other aspects, can include one or more of the following features. The hinge bracket can be disposed on the cabinet. A damping member can be coupled to the door and can be configured to reduce a rotation speed of the door. A damping member shaft can extend to a lower side of the damping member. The damping member can be coupled to the hinge shaft. The hinge shaft can include a recessed coupling part coupled to the damping member shaft. The coupling part can have a polygonal shape. The damping member shaft can have a sectional shape corresponding to that of the coupling part. A stopper can be included between the adjustment member and the damping member. The stopper can be configured to regulate a rotation of the door within a preset range. A second screw thread can be disposed on an inner surface of the adjustment member. The second screw thread can be coupled to the first screw thread. The second screw thread can be vertically moveable along the first screw thread. The hinge bracket can be disposed at a partition partitioning the storage room and can be coupled to the hinge shaft.

A further innovative aspect of the subject matter described here can be implemented as a refrigerator including a storage room defining a storage space; a door configured to open and close to provide or prevent access to the storage room; an upper hinge coupled to an upper side of the door, the upper hinge providing a rotation center of the door; a hinge bracket disposed at a lower side of the door, the hinge bracket supporting a load of the door, wherein the upper hinge and the hinge bracket dispose the door at a height relative to the storage room; a hinge shaft coupled to the hinge bracket; and an operation member coupled to the outside of the hinge shaft, the operation member being vertically moveable. When the operation member is moved, the height of the door can be vertically adjusted responsive to movement of the operation member.

This, and other aspects, can include one or more of the following features. The hinge shaft can include a screw part received into the operation member and having a first screw thread on an outer surface thereof. The operation member can have a second screw thread screw-coupled to the first screw thread. The second screw thread can be vertically moveable along the first screw thread. The hinge bracket can be disposed at a partition partitioning the storage room and coupled to the hinge shaft.

Particular embodiments of the subject matter described here can be implemented to realize one or more of the following potential characteristics. The hinge assembly can be used to adjust the height of the door when the door is misassembled or a roughness at which the refrigerator is uneven, thereby removing an inclination or deflection of the door. Further, in situations in which a refrigerator in which doors are respectively disposed at left and right sides to cover the storage space, any height difference, that may occur because the heights of both doors do not match each other, can be removed. The hinge assembly described here is simple, easy to produce, and involves low assembling costs.

The details of one or more embodiments are set forth in the accompanying drawings and the description below. Other features will be apparent from the description and drawings, and from the claims.

DETAILED DESCRIPTION OF THE EMBODIMENTS

Figure 1:
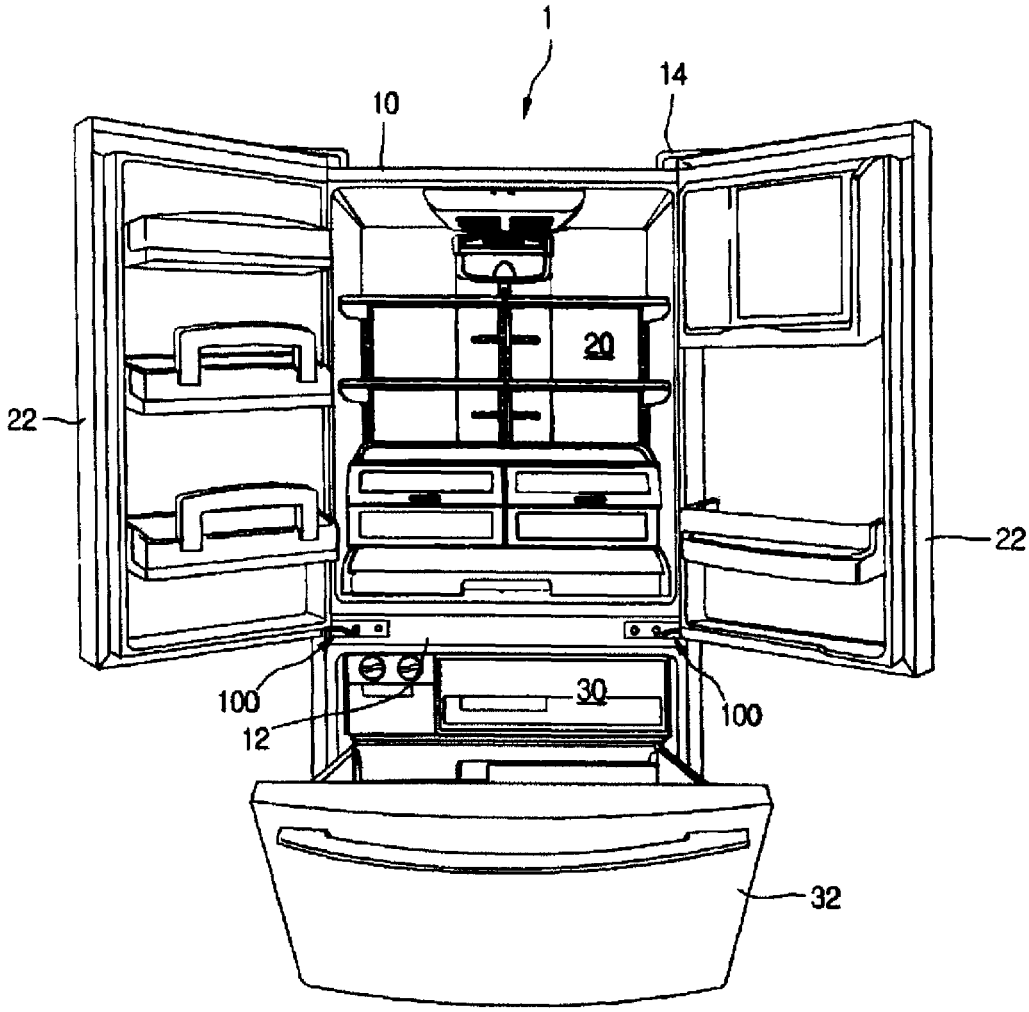
FIG. 1 is a front view of a refrigerator with a door opened according to an embodiment.

FIG. 1 is a front view of a refrigerator with a door opened according to an embodiment. In some embodiments, the refrigerator is a bottom freezer type refrigerator in which a freezer compartment is disposed below a refrigerator compartment and a pair of refrigerator compartment doors are provided at left and right sides. The refrigerator can include a hinge assembly that is rotatably installed.

Referring to FIG. 1, a refrigerator 1 according to an embodiment includes a cabinet 10 that defines a storage space. In addition, the refrigerator 1 includes doors 22 and 32 that can open and close to provide or prevent access to the storage space.

The cabinet 10 includes a partition 12 for partitioning the storage space therein. The storage space is divided into a refrigerator compartment 20 and a freezer compartment 30 by the partition 12. Each of the refrigerator compartment 20 and the freezer compartment 30 define a respective main body that is separated by the partition 12.

The refrigerator compartment 20 is disposed at an upper side, and the freezer compartment 30 is disposed at a lower side to define independent receiving spaces. A plurality of drawers and shelves can be provided inside the refrigerator compartment 20 and the freezer compartment 30 to store foods.

The refrigerator compartment 20 and the freezer compartment 30 are closed and opened by a refrigerator compartment door 22 and a freezer compartment door 32, respectively. The refrigerator compartment door 22 is rotatably coupled to the cabinet 10. In some embodiments, two refrigerator compartment doors (each numbered 22) can be disposed at both sides of the refrigerator compartment 20. In some embodiments, the freezer compartment door 32 can be withdrawn in a front direction.

The cabinet 10 includes an upper hinge 14 coupled to an upper side of the refrigerator compartment door 22 and a hinge assembly 100 disposed at a front side of the cabinet 10 or the partition 12 to support a lower side of the refrigerator compartment door 22. The hinge assembly 100 can be distinguished from the upper hinge 14, and thus referred to as a "lower hinge".

Upper and lower ends of the refrigerator compartment door 22 can be axially coupled to the cabinet by the upper hinge and the hinge assembly 100.

When the refrigerator compartment door 22 is coupled to the cabinet 10 by the upper hinge and the hinge assembly 100, the refrigerator compartment door 22 is at a vertical height relative to the cabinet 10. As shown in FIG. 1, the vertical height can be sufficient for the refrigerator compartment door 22 to cover the refrigerator compartment 20, for example. The hinge assembly 100 can adjust the vertical height of the refrigerator compartment door 22 relative to the cabinet 10. This will be described later with reference to drawings.

Figure 2:
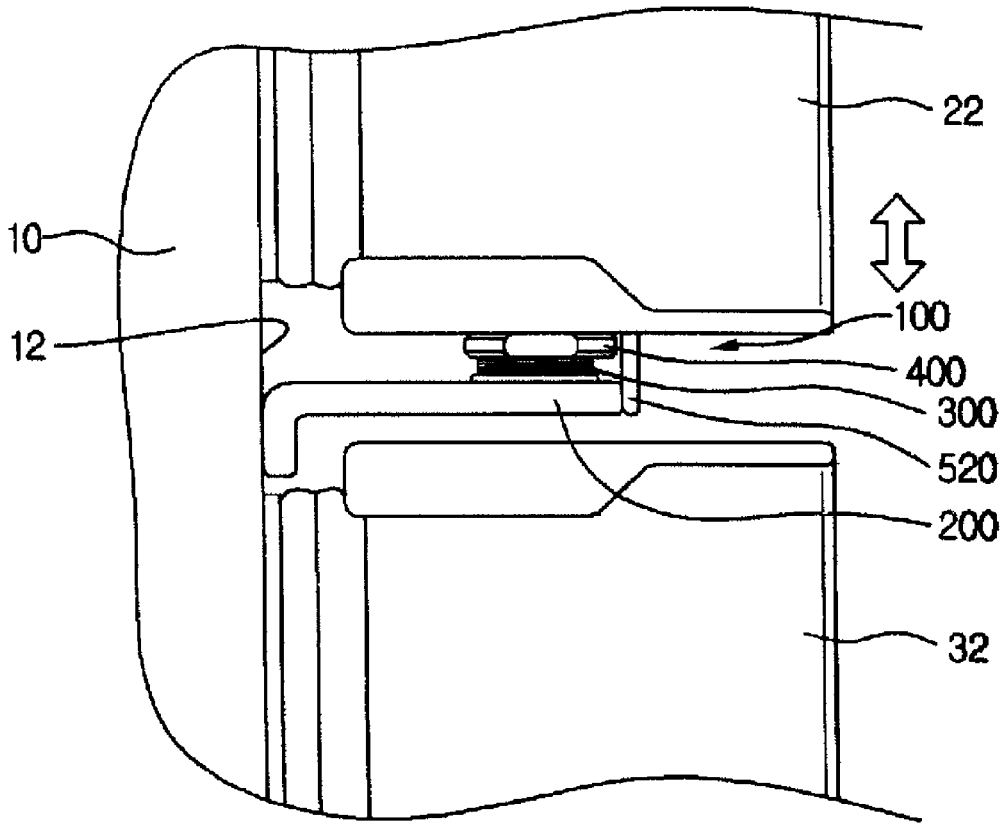
FIG. 2 is a side view illustrating a portion of the refrigerator according to an embodiment.
Figure 3:
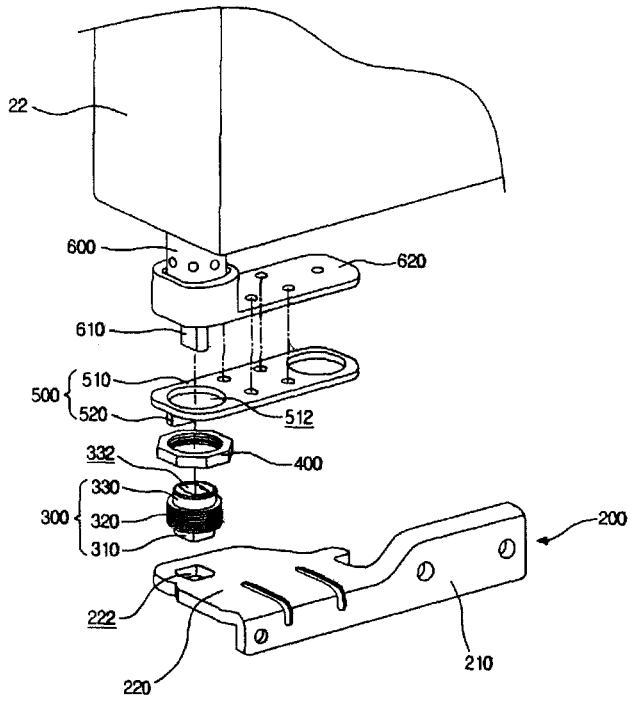
FIG. 3 is an exploded perspective view of a hinge assembly according to an embodiment.

FIG. 2 is a side view illustrating a portion of the refrigerator according to an embodiment, and FIG. 3 is an exploded perspective view of a hinge assembly according to an embodiment.

In some embodiments, the hinge assembly 100 is disposed on the refrigerator compartment door 22. It will be apparent that the hinge assembly 100 can be disposed on other portions of the refrigerator. For example, when the freezer compartment door 32 is rotatably disposed, the hinge assembly 100 can be disposed also on the freezer compartment door 32. Thus, hereinafter, the refrigerator compartment door is referred to as a door 22.

Referring to FIGS. 2 and 3, the hinge assembly 100 includes a hinge bracket 200 supporting a load of the door 22, a hinge shaft 300 coupled to the hinge bracket 200, and a vertically movable adjustment member 400 screw-coupled to the hinge shaft 300.

In detail, the hinge bracket 200 is disposed at a lower side of the door 200 to support the load of the door 22. Also, the hinge bracket 200 is disposed on a front surface of the cabinet 10 corresponding to a lower portion of the door 22. The hinge bracket 200 can be disposed on the partition 12.

The hinge bracket 200 includes a mounting part 210 coupled to the front surface of the cabinet 10 and a support 220 extending from the mounting part 210 to a front side of the cabinet 10.

The mounting part 210 can be horizontally disposed and stably fixed to the front surface of the cabinet 10 by a plurality of coupling members such as a screw that passes through the mounting part 210 and coupled to the cabinet 10.

The support 220 is bent from an upper end of the mounting part 210 in a direction perpendicular to the front surface of the cabinet 10 to support the lower side of the door 22.

A shaft coupling hole 222 coupled to the hinge shaft 300 is defined in the support 220. A fixing part 310 of the hinge shaft 300 that will be described later can be inserted into the shaft coupling hole 222.

The shaft coupling hole 222 can be punched into a polygonal shape such as a triangular shape or square shape or the like to prevent the hinge shaft 300 from being rotated in one direction by twisting moment generated when the door 22 is rotated.

The hinge shaft 300 and the hinge bracket 200 may not be separately manufactured, but be integrally manufactured when the hinge bracket 200 is manufactured. Here, the shaft coupling hole 222 may not be formed.

The hinge shaft 300 is coupled to the hinge bracket 200 to guide a vertical movement of the adjustment member 400. The hinge shaft 300 includes a fixing part 310, a screw part 320, and an insertion part 330.

The fixing part 310 can allow the hinge shaft 300 to be disposed on the hinge bracket 200. The fixing part 310 can be disposed at a lower portion of the hinge shaft 300 to have a sectional shape corresponding to that of the shaft coupling hole 222.

In a state where the hinge shaft is coupled to the hinge bracket 200, the fixing part is inserted into the shaft coupling hole 222. Thus, the hinge shaft 300 is not idly rotated within the hinge bracket 200.

The screw part 320 is disposed on the fixing part 310. The adjustment member 400 can be vertically and movably coupled to the screw part 320. The screw part 320 and the adjustment member 400 can be screw-coupled so that the screw part 320 can guide the vertical movement of the adjustment member 400.

Here, the screw part 320 can be received within the adjustment member 400.

A screw thread corresponding to that disposed on an inner surface of the adjustment member 400 is disposed on an outer surface of the screw part 320. The screw thread of the screw part 320 is referred to as "a first screw thread", and the screw thread of the adjustment member 400 is referred to as "a second screw thread".

The screw part 320 can have a length corresponding to a vertical distance by which the door 22 is moved.

When the adjustment member 400 is rotated, the second screw thread of the adjustment member 400 is moved along the first screw thread of the screw part 320 in a length direction of the hinge shaft 300, i.e., in a vertical direction. In this process, a height of the door 22 can be adjusted upwardly or downwardly.

The insertion part 330 extends upwardly from an upper end of the screw part 320 and is coupled to the lower side of the door 22. The insertion part 330 can have an outer diameter somewhat less than an inner diameter of the screw portion 320.

A coupling part 332 coupled to a damping member 600 is disposed on the insertion part 330. The coupling part 332 can have a polygonal shape such as a square shape.

The damping member 600 can reduce a rotation speed when the door 22 is closed. The damping member 600 can have a structure such as an auto hinge used as a rotation shaft and a damper of a general door.

The damping member 600 has a cylindrical shape. The damping member 600 is disposed at a position corresponding to a rotation center of the door 22.

The damping member 600 includes a damping member shaft 610 extending to the lower side of the door 22 and relatively rotatably disposed with respect to the damping member 600. The damping member shaft 610 is coupled to the coupling part 332. Also, the damping member shaft 610 can have a sectional shape corresponding to that of the coupling part 332 to prevent the damping member shaft 610 from being idly rotated within the coupling part 332.

A spring or cam structure can be provided inside the damping member 600 to reduce a rotation speed when the damping member shaft 610 is rotated. As necessary, oil for damping can be filled into the damping member 600.

A damping member fixing part 620 allowing the damping member 600 to be fixed to the door 22 is provided at a lower side of the damping member 600. The damping member 600 can be rotated together with the door 22.

When the damping member 600 is rotated, a rotation force of the damping member 600 is transmitted to the damping member shaft 610. However, the rotation force is offset by a coupling force between the damping member shaft 610 and the coupling part 332. As a result, a relative rotation movement is generated between the damping member 600 and the damping member shaft 610.

In this process, the damping structure provided inside the damping member 600, e.g., the spring, the cam, or the damping oil acts. As a result, in a predetermined rotation section in which the door 22 is closed, the rotation speed of the door 22 can be reduced by the damping member 600.

When the cam structure provided inside the damping member 600 acts, the door 22 can be automatically closed by a self-weight thereof in a predetermined section.

A stopper 500 can be disposed at the lower side of the door 22. The stopper 500 regulates a rotation of the door 22 within a present range, for example, a preset angle. For example, the stopper 500 restricts the rotation of the door 22 to prevent the door 22 from being rotated over the preset angle. The hinge shaft 300 passes through the stopper 500.

Also, the stopper 500 can be disposed between the damping member 600 and the adjustment member 400.

In detail, the stopper 500 has a plate shape and is disposed on a bottom surface of the door 22. The stopper 500 includes a door mounting part 510 mounted on the bottom surface of the door 22 and a hook part 520 vertically extending downward from the door mounting part 510.

The door mounting part 510 is closely attached to the bottom surface of the door 22 and fixed to a separate coupling member such as a screw. An opening 512 is defined in the door mounting part 510 so that the hinge shaft 300 is inserted to downwardly expose the damping member shaft 610.

The opening 512 can have a size greater than that of the insertion part 330 to insert an upper end of the hinge shaft 300 therein. Also, the opening 512 does not interfere with the door 22 when the door 22 is rotated.

The hook part 520 is bent downwardly from a front end thereof corresponding to a front side of the refrigerator 1. When the door 22 is rotated by a predetermined angle during the rotation of the door 22, the hook part 520 contacts the support part 220. At this time, the door 22 is not rotated any longer.

The opened angle of the door 22 can be determined by a formation position of the hook part 520 and a configuration of the support part 220 of the hinge bracket 200.

The adjustment member 400 has the same configuration as a nut. A screw thread corresponding to that of the screw part 320 of the hinge shaft 300 is disposed on an inner surface of the adjustment member 400. In a state where the adjustment member 400 is coupled to the screw part 320, the door 22 is installed on the hinge shaft 300.

When the door 22 is installed, a top surface of the adjustment member 400 can contact the bottom surface of the door 22 or a bottom surface of the stopper 500 to support the door 22.

The adjustment member 400 has an outer configuration equal to that of a general nut. Thus, when a height of the door 22 is adjusted, the adjustment member 400 can be easily rotated using a tool such as a wrench.

Hereinafter, an operation of the refrigerator including the above-described components according to an embodiment will be described in detail with reference to accompany drawings.

Figure 4:
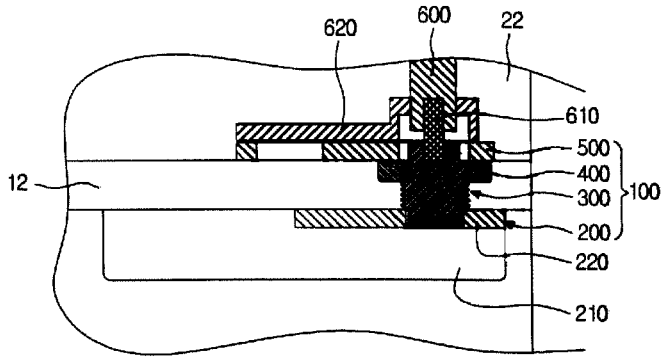
FIG. 4 is a sectional view of the hinge assembly in a state where the door is moved upwardly according to an embodiment.
Figure 5:
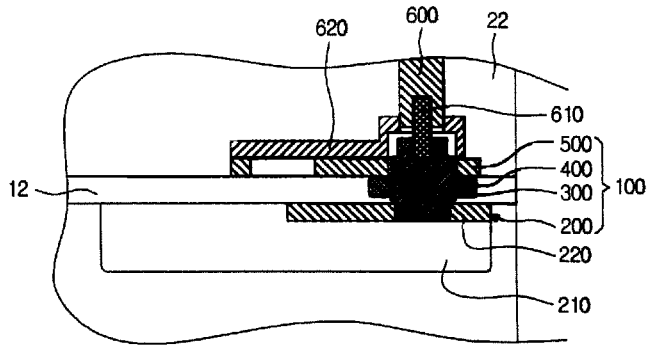
FIG. 5 is a sectional view of the hinge assembly in a state where the door is moved downwardly according to an embodiment.

FIG. 4 is a sectional view of the hinge assembly in a state where the door is moved upwardly according to an embodiment, and FIG. 5 is a sectional view of the hinge assembly in a state where the door is moved downwardly according to an embodiment.

Referring to FIGS. 4 and 5, to install the door 22, the hinge bracket 200 is be disposed on the cabinet 10. Then, the fixing part 310 of the hinge shaft 300 is inserted into the shaft coupling hole 222. In this state, the adjustment member 400 is coupled to the screw part 320.

The stopper 500 is coupled to the bottom surface of the door including the damping member 600. Then, the door 22 to which the stopper 500 is coupled is disposed on the hinge shaft 300.

Further, the insertion part 330 of the hinge shaft 300 passes through the stopper 500, is inserted inside the door 22, and is coupled to the damping member shaft 610. In this state, the door 22 is rotatable, and the top surface of the adjustment 400 supports the bottom surface of the door 22.

The adjustment member 400 can be rotated to adjust the height of the door 22. When the adjustment member 400 is rotated, the adjustment member 400 is moved along the screw part 320 upwardly or downwardly. In this process, the height of the door 22 supported by the adjustment member 400 can be vertically adjusted.

Thus, when the refrigerator 1 is installed, a height difference of the door 22 can be adjusted in case where the height difference of the door 22 is generated due to an inclination or roughness of an installation place or when the refrigerator 1 is shipped from the factory.

When a height of a side of the door 22 is low, a user can rotate the adjustment member 400 using a tool such as a wrench that can operate the adjustment member 400.

When the adjustment member 400 is rotated in one direction, e.g., in a clockwise direction, the adjustment member 400 is upwardly moved along the screw part 320 of the hinge shaft 300 as shown in FIG. 4.

When the adjustment member 400 is upwardly moved, since the adjustment member 400 is upwardly moved in a state where it 400 contacts the bottom surface of the door 22, the door 22 is also upwardly moved. Thus, the door 22 can be continuously moved upward to adjust the height difference of the door 22.

On the other hand, when the height of the side of the door 22 is high, the user can rotate the adjustment member 400 in the other direction, e.g., in a counterclockwise direction using the tool such as the wrench that can operate the adjustment member 400.

When the adjustment 400 is rotated, the adjustment member 400 is downwardly moved along the screw part 320 of the hinge shaft 300 as shown in FIG. 5. At this time, the stopper 500 and the damping member fixing part 620 can be downwardly moved together with the adjustment member 400.

When the adjustment member 400 is moved downwardly, since the adjustment member 400 is downwardly moved in a state where the adjustment member 400 contacts the bottom surface of the door 22, the door 22 is also downwardly moved. Thus, the door 22 can be continuously moved downward to adjust the height difference of the door 22.

Unlike the above description, the adjustment member 400 can be rotated in a direction opposite to the above-described direction (clockwise or counterclockwise directions).

Since the adjustment member 400 is vertically movable by its operation, the adjustment member 400 can be referred to as an "operation member" or a "movement support member".

Another embodiment of a refrigerator will be described in detail with reference to the accompanying drawings.

According to this embodiment, a rotatable door shaft within a door is coupled to a hinge shaft and rotated in a state where the hinge shaft is fixed when the door is rotated.

Thus, this embodiment is substantially similar to the foregoing embodiment with a variation on a structure of the door shaft. The same reference numerals refer to the same elements throughout, and their detailed descriptions will be omitted.

Figure 6:
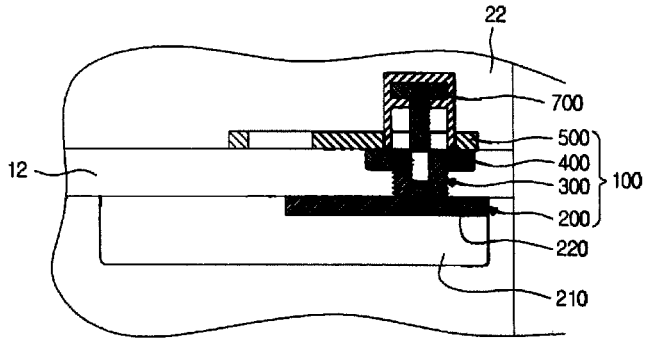
FIG. 6 is a sectional view of a hinge assembly according to another embodiment.

FIG. 6 is a sectional view of a hinge assembly according to another embodiment.

Referring to FIG. 6, a hinge shaft 300 upwardly extends at a hinge bracket 200 mounted on the cabinet 10. A screw part 320 having a screw thread corresponding to that disposed on an inner surface of an adjustment member 400 is disposed on an outer surface of the hinge shaft 300.

An insertion part 330 inserted into a bottom surface of a door 200 is disposed at an upper end of the hinge shaft 300. A coupling part 332 coupled to a door shaft 700 that is a rotation center of the door 22 is disposed on a top surface of the insertion part 330.

The coupling part 332 has an inwardly recessed shape so that the door shaft 700 is inserted into the hinge shaft 300. To prevent the coupling part 332 from being idly rotated with respect to the door shaft 700, the coupling part 332 and a portion of the door shaft 700 inserted into the coupling part 332 can have polygonal shapes, respectively.

Here, the door shaft 700 is inserted into the door 22 and coupled to the hinge shaft 300 inserted into the opened bottom surface of the door 22. When the door 22 is rotated, the door shaft 700 can be relatively rotated with respect to the door 20 in a state where the hinge shaft 300 is fixed.

When the adjustment member 400 is rotated to adjust a height of the door 22, the adjustment member 400 is vertically moved to allow the door 22 to be vertically moved, thereby adjusting the height of the door 22. Here, the door shaft 700 can be vertically moved also within the coupling part 332 according to the vertical movement of the door 22.

Another embodiment of a refrigerator will be described in detail with reference to the accompanying drawings.

According to this embodiment, an insertion part disposed at an upper end of a hinge shaft extends upwardly and is inserted into a door. The door is rotated about the insertion part as a rotation axis. Also, the door is rotated with respect to a hinge shaft to which the door is fixed.

Thus, this embodiment is substantially similar to the foregoing embodiments with a variation on a structure of the hinge shaft. The same reference numerals refer to the same elements throughout, and their detailed descriptions will be omitted.

Figure 7:
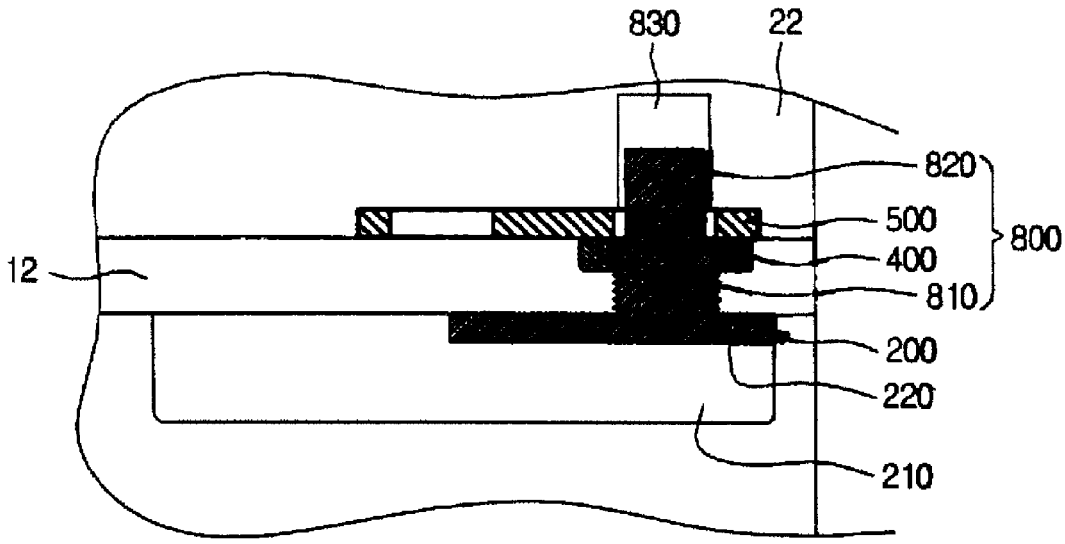
FIG. 7 is a sectional view of a hinge assembly according to another embodiment.

FIG. 7 is a sectional view of a hinge assembly according to another embodiment.

Referring to FIG. 7, a hinge shaft 800 upwardly extends at a hinge bracket 200. A screw part 810 having a screw thread corresponding to that disposed on an inner surface of an adjustment member 400 is disposed on an outer surface of the hinge shaft 800.

An insertion part 820 inserted into a bottom surface of a door 22 is disposed on an upper end of the hinge shaft 800. The insertion part 820 extends upwardly so that it 820 is inserted up to the inside of a hinge receiving part 830 provided inside the door 22.

The hinge receiving part 830 is disposed on an extending line of the hinge shaft 800 that is a rotation center of the door 22. The hinge receiving part 830 can have a length greater than that of the insertion part 820 to receive an upper portion of the hinge shaft 800.

Thus, when the door 22 is rotated, the door 22 is rotated on the hinge shaft 800 fixed to the hinge bracket 200 as a rotation axis.

When the adjustment member 400 is rotated to adjust a height of the door 22, the adjustment member 400 is vertically moved to adjust a height of the door 22. Also, the insertion part 820 can be vertically moved within the hinge receiving part 830 according to the adjustment of the adjustment member 400.

In the refrigerator according to the embodiments, since the hinge shaft having the screw thread is provided and the adjustment member movably along the hinge shaft and coupled to the hinge shaft is provided, the door can be easily supported.

Also, since the adjustment member is rotated to adjust the height of the door, deflection of the door or a height difference between a plurality of doors can be prevented.

Also, since the hinge assembly for adjusting the height of the door has a simplified structure, the manufacturing costs and the number of assembling processes can be reduced to improve productivity.

Also, since the adjustment member is rotated to adjust the height of the door at a easily operable position, convenience of use can be improved.

In the refrigerator according to the embodiments, since the hinge shaft having the screw thread is provided and the adjustment member movably along the hinge shaft and coupled to the hinge shaft is provided, the door can be easily supported. Thus, industrial applicability can be significantly improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a storage room defining a storage space;

a door configured to open and close to provide or prevent access to the storage room; and a hinge assembly configured to connect the door to the storage room at a height relative to the storage room, wherein the hinge assembly is configured to enable adjustment to the height of the door, wherein the hinge assembly comprises:

a hinge bracket supporting a lower side of the door, the hinge bracket having a shaft coupling hole of a polygonal shape;

a hinge shaft fixed to prevent rotation of the hinge shaft about the hinge bracket and to provide a rotation center about which the door rotates, the hinge shaft having a first screw thread and a fixing part which has a section corresponding to the shaft coupling hole, and a vertically movable adjustment member disposed on the lower side of the door, the adjustment member having a second screw thread coupled to the first screw thread;

a damping member coupled to the door and configured to reduce a rotation speed of the door; and a damping member shaft extending to a lower side of the damping member, the damping member being coupled to the hinge shaft, wherein the hinge shaft comprises a coupling part coupled to the damping member shaft and recessed on an end portion of the hinge shaft to receive the damping member shaft, the coupling part has a polygonal shape, and the damping member shaft has a sectional shape corresponding to that of the coupling part such that the damping member shaft is received within the polygonal shaped recess of the coupling part.

2. The refrigerator according to claim 1, wherein the hinge assembly is configured to enable adjustment to the height of the door from a first position that is at a first height relative to the storage room prior to the adjustment to the height of the door to a second position that is at a second height relative to the storage room after the adjustment to the height of the door, wherein the second height is different from the first height.

3. The refrigerator according to claim 1, wherein the hinge shaft comprises:

a screw part extending upwardly from the fixing part, the screw part having the first screw thread on an outer surface thereof; and an insertion part inserted into the door.

4. The refrigerator according to claim 3, wherein the second screw thread is disposed on an inner surface of the adjustment member, and the adjustment member is configured to be rotatably coupled to the outside of the screw part.

5. A refrigerator comprising:

a cabinet defining a storage room;

a door rotatably disposed at a side of the cabinet, the door configured to open and close to provide or prevent access to the storage room, wherein the door is disposed at a height relative to the cabinet;

a hinge bracket disposed on the cabinet, the hinge bracket supporting a load of the door and having a shaft coupling hole of a polygonal shape;

a hinge shaft extending upwardly from the hinge bracket, the hinge shaft being fixed to prevent rotation of the hinge shaft about the hinge bracket, the hinge shaft having a first screw thread and a fixing part which has a section corresponding to the shaft coupling hole; and an adjustment member screw-coupled to the hinge shaft, the adjustment member supporting a lower side of the door and rotatably coupled to an outside of the hinge shaft;

a damping member coupled to the door and configured to reduce a rotation speed of the door; and a damping member shaft extending to a lower side of the damping member, the damping member being coupled to the hinge shaft, wherein the hinge shaft comprises a coupling part coupled to the damping member shaft and recessed on an end portion of the hinge shaft to receive the damping member shaft, the coupling part has a polygonal shape, and the damping member shaft has a sectional shape corresponding to that of the coupling part such that the damping member shaft is received within the polygonal shaped recess of the coupling part, wherein the adjustment member is rotatably coupled to the outside of the hinge shaft, and wherein the adjustment member is configured such that the door is vertically moved when the adjustment member is rotated to adjust the height.

6. The refrigerator according to claim 5, wherein the hinge bracket is disposed on the lower side of the door.

7. The refrigerator according to claim 5, further comprising:

a stopper between the adjustment member and the damping member, wherein the stopper is configured to regulate a rotation of the door within a preset range.

8. The refrigerator according to claim 5, wherein a second screw thread is disposed on an inner surface of the adjustment member, the second screw thread being coupled to the first screw thread, the second screw thread vertically moveable along the first screw thread.

9. The refrigerator according to claim 5, wherein the hinge bracket is disposed at a partition partitioning the storage room and coupled to the hinge shaft.

* * * * *